US008201619B2

(12) United States Patent
Greaney et al.

(10) Patent No.: US 8,201,619 B2
(45) Date of Patent: Jun. 19, 2012

(54) CORROSION RESISTANT MATERIAL FOR REDUCED FOULING, A HEAT TRANSFER COMPONENT HAVING REDUCED FOULING AND A METHOD FOR REDUCING FOULING IN A REFINERY

(75) Inventors: Mark A. Greaney, Upper Black Eddy, PA (US); Thomas Bruno, Raritan, NJ (US); Ashley E. Cooper, Baton Rouge, LA (US); Ian A. Cody, Annandale, NJ (US); ChangMin Chun, BelleMead, NJ (US)

(73) Assignee: ExxonMobil Research & Engineering Company, Annandale, NJ (US)

( * ) Notice: Subject to any disclaimer, the term of this patent is extended or adjusted under 35 U.S.C. 154(b) by 1240 days.

(21) Appl. No.: 11/641,754

(22) Filed: Dec. 20, 2006

(65) Prior Publication Data

US 2007/0158054 A1 Jul. 12, 2007

Related U.S. Application Data

(60) Provisional application No. 60/751,985, filed on Dec. 21, 2005.

(51) Int. Cl.
*F28F 13/18* (2006.01)
*F28F 9/02* (2006.01)

(52) U.S. Cl. ..... 165/133; 165/134.1

(58) Field of Classification Search ..... 165/133, 165/134.1, 157, 158; 148/286, 287, 427; 420/583

See application file for complete search history.

(56) References Cited

U.S. PATENT DOCUMENTS

| | | | | |
|---|---|---|---|---|
| 1,657,027 | A * | 1/1928 | Nelson | 165/83 |
| 3,835,817 | A | 9/1974 | Tuomaala | |
| 3,969,153 | A * | 7/1976 | Suzuki et al. | 148/286 |
| 4,162,617 | A | 7/1979 | Schmidt et al. | |
| 4,168,184 | A * | 9/1979 | Hultquist et al. | 428/472.1 |
| 4,297,150 | A | 10/1981 | Foster et al. | |
| 4,369,101 | A | 1/1983 | Wolff et al. | |
| 4,496,401 | A * | 1/1985 | Dawes et al. | 148/217 |
| 4,505,017 | A | 3/1985 | Schukei | |
| 4,670,590 | A | 6/1987 | Kambara et al. | |
| 4,891,190 | A | 1/1990 | Carter et al. | |
| 5,085,745 | A | 2/1992 | Farber et al. | |
| 5,263,267 | A | 11/1993 | Buttner et al. | |
| 5,268,045 | A | 12/1993 | Clare | |

(Continued)

FOREIGN PATENT DOCUMENTS

DE 19748240 5/2001

(Continued)

OTHER PUBLICATIONS

International Search Report, PCT Application No. PCT/US2006/048359, Nov. 13, 2007.

(Continued)

*Primary Examiner* — Tho V Duong
(74) *Attorney, Agent, or Firm* — Glenn T. Barrett

(57) ABSTRACT

A method and device for reducing sulfidation corrosion and depositional fouling in heat transfer components within a refining or petrochemical facility is disclosed. The heat transfer components are formed from a corrosion and fouling resistant steel composition containing a Cr-enriched layer and having a surface roughness of less than 40 micro inches (1.1 μm).

16 Claims, 4 Drawing Sheets

U.S. PATENT DOCUMENTS

| | | | | |
|---|---|---|---|---|
| 5,320,721 | A | 6/1994 | Peters | |
| 5,479,959 | A | 1/1996 | Stotelmyer et al. | |
| 5,499,656 | A | 3/1996 | Stotelmyer et al. | |
| 5,507,923 | A | 4/1996 | Stouse | |
| 5,540,275 | A | 7/1996 | Eisinger | |
| 5,873,408 | A | 2/1999 | Bellet et al. | |
| 6,038,882 | A | 3/2000 | Kuroda et al. | |
| 6,174,610 | B1 * | 1/2001 | Ohmi | 428/469 |
| 6,413,407 | B1 | 7/2002 | Bruns et al. | |
| 6,648,988 | B2 * | 11/2003 | Ramanarayanan et al. | 148/280 |
| 2001/0027867 | A1 * | 10/2001 | Gandy et al. | 166/369 |
| 2003/0022027 | A1 | 1/2003 | Groll | |
| 2003/0098245 | A1 | 5/2003 | Lin et al. | |
| 2004/0001966 | A1 | 1/2004 | Subramanian et al. | |
| 2004/0191155 | A1 | 9/2004 | Mahler et al. | |
| 2004/0265604 | A1 * | 12/2004 | Benum et al. | 428/469 |
| 2005/0045251 | A1 * | 3/2005 | Nishiyama et al. | 148/327 |

FOREIGN PATENT DOCUMENTS

| | | | |
|---|---|---|---|
| DE | 103 18 528 | A1 | 11/2004 |
| EP | 0 022 349 | A | 1/1981 |
| EP | 247209 | B1 | 7/1990 |
| EP | 203380 | B1 | 10/1991 |
| EP | 0 698 653 | A1 | 8/1995 |
| EP | 0 716 282 | A | 6/1996 |
| EP | 0 780 656 | A | 6/1997 |
| EP | 1 052 307 | A2 | 5/2000 |
| EP | 980729 | B1 | 1/2001 |
| EP | 1 167 866 | A2 | 5/2001 |
| EP | 1306469 | A1 | 5/2003 |
| EP | 1 798 511 | A1 | 6/2007 |
| FR | 2714359 | | 6/1995 |
| FR | 2 795 337 | A1 | 12/2000 |
| FR | 2 795 748 | A | 1/2001 |
| GB | 435 870 | A | 9/1936 |
| GB | 532 144 | A | 1/1941 |
| GB | 846 994 | | 9/1960 |
| GB | 1 099 742 | A | 1/1968 |
| GB | 2 147 078 | A | 5/1985 |
| GB | 2 152 204 | A | 7/1985 |
| GP | 1 247 429 | A | 9/1971 |
| JP | 60023794 | | 2/1985 |
| JP | 61204398 | | 9/1986 |
| JP | 61204399 | | 9/1986 |
| JP | 61204400 | | 9/1986 |
| JP | 62 017169 | A | 1/1987 |
| JP | 62214200 | | 9/1987 |
| JP | 01306599 | | 12/1989 |
| JP | 03180496 | | 8/1991 |
| JP | 03180497 | | 8/1991 |
| JP | 04311599 | | 11/1992 |
| JP | 07285027 | | 10/1995 |
| JP | 10204700 | | 8/1998 |
| KR | 2001105637 | | 6/2002 |
| RU | 2055709 | C1 | 3/1996 |
| SU | 246246 | | 10/1969 |
| SU | 260783 | | 8/1970 |
| SU | 357055 | | 12/1972 |
| SU | 496148 | | 3/1976 |
| SU | 776833 | | 7/1980 |
| SU | 981464 | | 12/1982 |
| SU | 1194914 | A | 10/1985 |
| SU | 1359085 | A1 | 12/1987 |
| SU | 1574687 | A1 | 6/1990 |
| WO | WO 98/16792 | A | 4/1998 |
| WO | WO 9814297 | | 4/1998 |
| WO | WO 9946112 | | 9/1999 |
| WO | WO 00/45965 | A | 8/2000 |
| WO | WO 0073722 | A1 | 12/2000 |
| WO | WO 02/08498 | A | 1/2002 |
| WO | WO 2004051174 | A1 | 6/2004 |

OTHER PUBLICATIONS

Written Opinion, PCT Application No. PCT/US2006/048359, Nov. 13, 2007.

Singapore Appl. No. 200804404-2, Search Report from Austrian Patent Office, dated Aug. 10, 2010, 7 pgs.

Singapore Appl. No. 200804404-2, Written Opinion from Austrian Patent Office, dated Aug. 10, 2010, 8 pgs.

International Search Report, PCT/US2007/011828, mailed Dec. 21, 2007.

* cited by examiner

CORROSION RESISTANT MATERIAL FOR REDUCED FOULING, A HEAT TRANSFER COMPONENT HAVING REDUCED FOULING AND A METHOD FOR REDUCING FOULING IN A REFINERY

CROSS REFERENCE TO RELATED APPLICATION

This application relates to and claims priority to U.S. Provisional Patent Application No. 60/751,985, filed Dec. 21, 2005, entitled "Corrosion Resistant Material For Reduced Fouling, A Heat Exchanger Having Reduced Fouling And A Method For Reducing Heat Exchanger Fouling in a Refinery," the disclosure of which is hereby specifically incorporated by reference.

FIELD OF THE INVENTION

This invention relates to the reduction of sulfidation or sulfidic corrosion and the reduction of depositional fouling in general and in particular the reduction of sulfidation or sulfidic corrosion and the reduction of depositional fouling in heat transfer components, which include but are not limited to heat exchangers, furnaces and furnace tubes located in refining facilities and petrochemical processing facilities. In particular, the present invention relates to the reduction of corrosion and fouling associated with heat transfer components used in the context of a crude oil refinery and petrochemical processing applications. The present invention relates to improved heat-transfer components which exhibit improved corrosion resistance and improved resistance to fouling as well as improved heat transfer properties. The present invention is also directed to a method of reducing fouling in existing and new heat transfer components for use in refining and petrochemical processing applications. The present invention is also directed to a method of reducing sulfidation or sulfidic corrosion and fouling.

BACKGROUND OF THE INVENTION

Heat transfer components are used in refinery and petrochemical processing applications at various locations within the facilities to adjust the temperature (i.e., heat or cool) of the processed fluid (e.g., crude oil or derivatives thereof). The heat transfer components (e.g., a heat exchanger, furnaces, and furnace tubes) may be near the furnace to pre-heat the temperature of the oil prior to entry into the furnace (i.e., late-train). A typical tube-in-shell heat exchanger includes a plurality of tubes through which the oil may flow through and around. A hot fluid and a cold fluid enter separate chambers or tubes of the heat exchanger unit. The hot fluid transfers its heat to the cold fluid. The heat exchanger is designed to efficiently transfer heat from one fluid to another. The hot and cold fluids are never combined. Heat transfer occurs through the tube wall that separates the hot and cold liquids. By employing the correct flow rate and maximizing the area of the partition, heat exchanger performance can be optimally controlled. A variety of other heat exchanger designs, such as spiral heat exchangers, tube-in-tube heat exchangers and plate-and-frame heat exchangers operate essentially on the same principles.

During normal use with contact between the oil and the heat exchanger, corrosion and the build-up of deposits occurs. This build-up of deposits is often called fouling. Fouling adversely impacts the optimal control of the heat exchanger.

Fouling in this context is the unwanted deposition of solids on the surfaces of the tubes of the heat exchanger, which leads to a loss in efficiency of the heat exchanger. The loss in heat transfer efficiency results in higher fuel consumption at the furnace and reduced throughput. The buildup of foulants in fluid transfer components results in reduced throughput, higher loads on pumping devices and plugging of downstream equipment as large pieces of foulant periodically dislodge and flow downstream. As a result, the tubes of the exchanger must be periodically removed from service to be cleaned. This decreases overall facility reliability due to shutdowns for maintenance. This also leads to increased manpower requirements due to the number of cleaning crews required to service fouled heat exchanger and process fluid transfer tubes. Another detriment is an increase in volatile organic emission resulting from the cleaning process.

During normal use, the surfaces of the tubes of the heat exchanger are subject to corrosion as a result of the prolonged exposure to the stream of crude and other petroleum fractions. Corrosion on the surfaces of the tubes creates an uneven surface that can enhance fouling because the various particles found in the petroleum stream may attach themselves to the roughened surface. Fouling is not limited solely to the crude oils being processed. The vacuum residual streams are often used to heat the crude within the tubes. These streams often contain solids and are high fouling. Fouling can be associated with other process streams including but not limited to process gases (e.g., air).

While the problems of fouling extend beyond petroleum refining and petrochemical processing, the presence of crude oil presents numerous obstacles in preventing fouling that are unique to petroleum refining and petrochemical processing not present in other industries. Crude oil, in the context of fouling, is in reality more than simply a petroleum product produced from an underground reservoir. Crude oil is a complex mixture of organic and inorganic components which may result in a variety of foulant deposits on the surfaces of the heat exchanger including but not limited to both surfaces of the heat exchanger tubes, the baffles and the tube sheets. For example, crude oil as it is received at the refinery often contains corrosion byproducts such as iron sulfide, which are formed by the corrosion of drilling tubulars, pipelines, tanker holds and crude storage tanks. This material, under the right conditions, will deposit within heat exchangers resulting in depositional fouling. Crude oils often contain aqueous contaminants, some of which arrive at the refinery. Desalting is used to remove most of this material, but some of these contaminants pass through the desalter into the crude preheat train. These dissolved salts can also contribute to depositional fouling. Sodium chloride and various carbonate salts are typical of this type of foulant deposit. As more and more chemicals are used to enhance production of crude from old reservoirs, additional inorganic materials are coming to the refineries in the crude oil and potentially contributing to fouling.

Crude oils are typically blended at the refinery, and the mixing of certain types of crudes can lead to another type of foulant material. The asphaltenic material that is precipitated by blending of incompatible crudes will often lead to a predominantly organic type of fouling, which with prolonged heating, will form a carbonaceous or coke-like foulant deposit. Crude oils often also contain acidic components that directly corrode the heat exchanger materials as well. Naphthenic acids will remove metal from the surface and sulfidic components will cause sulfidic corrosion which forms iron sulfide. This sulfidic scale that is formed is often referred to as sulfide induced fouling.

Synthetic crudes are derived from processing of bitumens, shale, tar sands or extra heavy oils and are also processed in refinery operations. These synthetic crudes present additional fouling problems, as these materials are too heavy and contaminant laden for the typical refinery to process. The materials are often pre-treated at the production site and then shipped to refineries as synthetic crudes. These crudes may contain fine particulate silicaceous inorganic matter, such as in the case of tar sands. Some may also contain reactive olefinic materials that are prone to forming polymeric foulant deposits within heat exchangers. As can be understood from this discussion, crude oils are complex mixtures capable of forming a wide-range of foulant deposit types.

Currently, there are various techniques available for reducing fouling in refinery operations. One technique is avoiding the purchase of high-fouling crudes or corrosive crudes. This, however, reduces the pool of feedstock that is potentially available to the refinery. Additionally, the crude oil can be tested to determine whether or not the crude oil is compatible with the refinery. Again, this can reduce the feedstock potentially available to the refinery. Anti-foulant agents may also be added to the refinery stream. While these techniques are useful in reducing the rate of fouling within the heat transfer components, fouling can still occur under certain circumstances. The heat exchangers must still be routinely removed from service for cleaning to remove the build-up of contaminants. Furnace tubes must be taken off-line and steam-air decoked or pigged because of foulant deposition. Other alternative cleaning methods include the use of mechanical devices (e.g., "SPIRELF" and "brush and basket" devices). These devices, however, have low reliability and high maintenance needs.

There is a need to significantly reduce fouling in heat transfer components in refinery and petrochemical processing operations that does not encounter the drawbacks associated with the current techniques.

SUMMARY OF THE INVENTION

It is an aspect of the present invention to provide a heat transfer component that is resistant to fouling. The heat transfer component is used to either raise or lower the temperature of a process fluid or stream. The process fluid or stream is preferably crude oil based and is processed in a refinery or petrochemical facility. The present invention, however, is not intended to be limited solely to the use of crude oils, other process streams are considered to be well within the scope of the present invention. The heat transfer component may be a heat exchanger, a furnace, furnace tubes or any other component within a refinery or petrochemical facility that is capable of transferring heat from one medium to another which is also susceptible to fouling including but not limited to Crude Preheat, Coker preheat, FCC slurry bottoms, debutanizer exchanger/tower, other feed/effluent exchangers and furnace air preheaters in refinery facilities and flare compressor components and steam cracker/reformer tubes in petrochemical facilities. The heat transfer component contains at least one heat transfer element. It is contemplated that the heat transfer component is a heat exchanger for heating crude oil in a refinery stream prior to the crude entering a furnace, whereby the heat exchanger is resistant to fouling. The description of the present invention in the context of a heat exchanger is intended to be illustrative and not limiting the application of the present invention to heat exchangers. The heat exchanger may be a tube-in-shell type heat exchanger having a tube bundle located within a housing. The present invention is not intended to be limited to tube-in-shell exchangers; rather, the present invention has application within other exchangers which are prone to fouling when subject to petroleum and/or vacuum residual streams. The tube-in-shell exchanger includes a housing having a wall forming a hollow interior. The wall has an inner surface that is adjacent the hollow interior. The heat transfer element may be a tube bundle located within hollow interior of the housing. The crude oil is heated within the hollow interior of the heat exchanger housing as the crude oil flows over the tube bundle. The tube bundle preferably includes a plurality of heat exchanger tubes.

In accordance with the present invention, each heat exchanger tube may be formed from an aluminum or aluminum alloy coated carbon steel or a steel composition that is resistant to sulfidation or sulfidic corrosion and fouling. The use of aluminum or aluminum alloy coated carbon steel or a steel composition that is resistant to sulfidation and fouling significantly reduces fouling and corrosion, which produces numerous benefits including an increase in heating efficiency, a reduction in the overall amount of energy needed to heat the crude oil, an increase in refinery throughput and a significant reduction in refinery downtime.

It is preferable that at least one of the interior surface of the wall of the heat transfer component and the inner and/or outer surfaces of the plurality of heat exchanger tubes having a surface roughness of less than 40 micro inches (1.1 μm). Preferably, the surface roughness is less than 20 micro inches (0.5 μm). More preferably, the surface roughness is less than 10 micro inches (0.25 μm). It is contemplated that both the inner and outer surfaces of the plurality of heat exchanger tubes may have the above-mentioned surface roughness. Such a surface roughness significantly reduces fouling. The smooth surface within the inner diameter of the tubes reduces fouling of the petroleum stream flowing through the tubes. The smooth surfaces on the outer diameter of the tubes and on the inner surface of the housing will reduce fouling of the vacuum residual stream within the housing. It is also contemplated that the surfaces of the baffles located within the heat exchanger and the surfaces of the tube sheets, which secure the tubes in place may also have the above-mentioned surface roughness. Such a surface roughness would significantly reduce fouling on these components.

In accordance with another aspect of the present invention, the plurality of heat exchanger tubes are preferably formed from a steel composition with a chromium enriched layer. The composition of the steel forming the heat exchanger tubes is preferably formed from a metal composition containing X, Y and Z. In the context of the present invention, X denotes a metal that is selected from the group consisting of Fe, Ni, and Co. The group also contains mixtures of these components. Y denotes Cr. Finally, Z denotes at least one alloying element selected from the group consisting of Si, Al, Mn, Ti, Zr, Hf, V, Nb, Ta, Mo, W, Sc, Y, La, Ce, Pt, Cu, Ag, Au, Ru, Rh, Ir, Ga, In, Ge, Sn, Pb, B, C, N, O, P, and S. While other compositions are considered to be within the scope of the present invention, the above-described composition has been found to reduce fouling. The use of an aluminum or aluminum alloy coated carbon steel has also been found to reduce fouling and is considered to be within the scope of the present invention.

Each of the plurality of heat exchanger tubes has a Cr-enriched layer. The Cr-enriched layer is formed on the tube and is formed from a steel having a similar composition to the above-described steel composition X, Y and Z. The Cr-enriched layer differs from the remaining portion of the heat exchanger tube in that the ratio of Y to X in the Cr-enriched layer being greater than the ratio of Y to X in the remaining portion of the tube. The Cr-enriched layer has a surface roughness of less than 40 micro inches (1.1 μm), preferably less than 20 micro inches (0.5 μm) and more preferably less than 10 micro inches (0.25 μm). The enriched layer is preferably formed on both the inner diameter surface and the outer diameter surface of the tube. The surfaces of the baffles and the tube sheets may also include a Cr-enriched and reduced surface roughness layer.

In accordance with another aspect of the present invention, it is contemplated that the Cr-enriched layer may be formed using one of several techniques. The Cr-enriched layer may be formed by electro-polishing the tube in a suitable solution (which may contain chromic acid when 5-chrome steels are used). Electro-polishing is effective when the Cr content in the steel composition is less than about 15 wt. %. While the concept of electro-polishing is known, the use of electro-polishing has primarily been limited to stainless steels wherein the Cr content in the steel composition is greater than about 18 wt. % and not for low-chromium steels such as a 5-chrome steel or a carbon steel.

The formation of the Cr-enriched layer is not limited to the use of electro-polishing; rather, numerous other formation techniques are considered to be well within the scope of the present invention including but not limited to electroplating, bright annealing, passivation, thermal spray coating, laser deposition, sputtering, physical vapor deposition, chemical vapor deposition, plasma powder welding overlay, cladding, and diffusion bonding. It is contemplated that the corrosion resistant material, disclosed herein, may be used in other applications to reduce corrosion and fouling.

Each of the surfaces in the heat transfer components and particularly the heat exchanger tubes in accordance with the present invention preferably has a protective layer formed thereon. The surfaces of the baffles and the tube sheets may also include an enriched layer. The protective layer is preferably formed on the outer surface of the Cr-enriched layer. The protective layer may be an oxide layer, a sulfide layer, an oxysulfide layer or any combination thereof. The protective layer preferably includes a material selected from the group consisting of a magnetite, an iron-chromium spinel, a chromium oxide, oxides of the same and mixtures thereof. In the accordance with the present invention, the protective layer is preferably formed on the Cr-enriched layer after the heat exchanger tubes are located within the exchanger and the heat exchanger is operational. The protective layer forms when the Cr-enriched layer is exposed to the process streams (e.g., petroleum stream or vacuum residual stream or air) and high temperatures. The temperature at which the protective layer forms varies. In a late-train heat exchanger applications, the protective layer forms at temperatures up to 400° C. In applications in a furnace or outside the late-train heat exchanger, the protective layer forms at temperatures up to 600° C. In petrochemical applications including use in steam cracker and reformer tubes, the protective layer forms at temperatures up to 1100° C. The temperatures utilized during the formation of the protective layer will be dependent on the metallurgy of the steel being acted upon. The skilled artisan can easily determine the upper temperature constraints based on the steel's metallurgy.

It has also been found that aluminum or aluminum alloy coated carbon steels are effective in reducing fouling. The surfaces of these coated steels have a surface roughness of less than 40 micro inches (1.1 μm), preferably less than 20 micro inches (0.5 μm) and more preferably less than 10 micro inches (0.25 μm). Similarly, titanium and titanium alloys can be effective in reducing fouling. The desired surface roughness may be obtained by electropolishing or honing the aluminum or titanium coating. The desired surface roughness may also be obtained by abrasive finishing methods including but not limited to precision grinding, microgrinding, mechanical polishing, lappling and heat treatment during the coated strip forming process.

It is another aspect of the present invention to provide a method of reducing fouling in a refinery or petrochemical facility. The method may result in significant cost savings because the number of scheduled downtimes to address heat transfer component fouling is significantly reduced. Furthermore, the heat transfer components operate more efficiently because the harmful effects of fouling are reduced. The present method is especially well suited for existing heat exchangers, which may presently be plagued with fouling. The method of reducing fouling in accordance with the present invention includes removing the existing heat exchanger tubes from the heat exchanger. The method further includes installing a plurality of replacement heat exchanger tubes.

While it is preferable to replace all of the existing heat exchanger tubes with replacement tubes having the above-described construction in order to maximize the reduction in fouling, the present invention is not intended to be so limited. It is also contemplated that only a portion of the existing heat exchanger tubes be replaced with replacement tubes. While such a construction may not result in the same reduction in fouling, a degree of fouling mitigation will be obtained. The determination of the number and location of existing tubes to be replaced by the replacement tubes can be determined by a physical inspection of the tubes within the bundle within the heat exchanger. It is contemplated that the existing tubes containing little or no fouling may remain. The present invention is not limited to retrofitting existing heat transfer components; rather, it is contemplated that the heat transfer components which exhibit fouling may be replaced with a new heat transfer component having the same desired material compositions and surface roughness described herein. Furthermore, it is contemplated that fouling can be mitigated in new refinery and/or petrochemical processing lines by installing heat transfer components having the same desired material compositions and surface roughness described herein.

It is another aspect of the present invention to reduce sulfidation or sulfidic corrosion and corrosion induced fouling. While the primary objective of the present invention is to provide such resistance to corrosion and fouling in the context of heat transfer components subject to a flow of crude oil, the present invention is not intended to be so limited. It is contemplated that the present invention is suitable for use in other refining applications where the mitigation of fouling is a concern. In accordance with this aspect of the present invention, a method of providing sulfidation or sulfidic corrosion resistance and corrosion induced fouling resistance is disclosed. The method is suitable for use on a metal surface that is subject to a process stream (e.g., stream of crude oil or distilled fractions of crude oil) at high temperatures. In a late-train heat exchanger applications, the protective layer forms at temperatures up to 400° C. In applications in a furnace or outside the late-train heat exchanger, the protective layer forms at temperatures up to 600° C. In petrochemical applications including use in steam cracker and reformer tubes, the protective layer forms at temperatures up to 1100° C. The method includes providing a metal layer formed on a steel composition comprising X, Y, and Z. The material X is preferably a metal selected from the group consisting of Fe, Ni, Co, Ti and mixtures thereof. The material Y is Cr. It is also contemplated that the material Y may comprise Ni, O, Al, Si and mixtures thereof. The material Z is preferably at least one alloying element selected from the group consisting of Si, Al, Mn, Ti, Zr, Hf, V, Nb, Ta, Mo, W, Sc, Y, La, Ce, Pt, Cu, Ag, Au, Ru, Rh, Ir, Ga, In, Ge, Sn, Pb, B, C, N, O, P, and S. The metal layer preferably includes a Cr-enriched layer located thereon. Alternatively, the metal layer may include Ni, P, Ti, Al, Si, mixtures/compounds/alloys of these elements in an enriched layer located thereon. The enriched layer is formed from the same material X, Y and Z, however, the ratio of Y to X in the enriched layer is greater than the ratio of Y to X in the metal layer. The metal surface preferably has a surface roughness of less than 40 micro inches (1.1 μm). The surface roughness is preferably less than 20 micro inches (0.5 μm) and more preferably less than 10 micro inches (0.25 μm).

The method further includes forming a protective layer on a surface of the Cr-enriched layer. The layer is formed in-situ within the heat exchanger. The protective layer is preferably formed by exposing the Cr-enriched layer to a process stream at high temperatures. In late-train heat exchanger applications, the protective layer forms at temperatures up to 400° C. In applications in a furnace or outside the late-train heat exchanger, the protective layer forms at temperatures up to 600° C. In petrochemical applications including use in steam cracker and reformer tubes, the protective layer forms at temperatures up to 1100° C. The protective layer preferably includes a material selected from the group consisting of a magnetite, an iron-chromium spinel, a chromium oxide, other oxides and mixtures thereof. It is contemplated that the protective layer may contain a mixed oxide sulfide thiospinel.

It is another aspect of the present invention to combine corrosion resistance with a desired surface smoothness, which has synergistic impact on fouling mitigation. A smooth surface alone will reduce fouling temporarily, but with time and corrosion, the smoothness is lost and so is the initial benefit. Similarly, a rough textured, though corrosion-resistant surface is equally less effective at foulant reduction. In contrast, a smooth, corrosion-resistant surface will provide a long-lasting foulant resistant surface.

It is another aspect of the present invention to provide a corrosion resistant barrier layer for use in a refinery and/or petrochemical operation. The corrosion resistant barrier layer may include a steel composition layer comprising X, Y, and Z. A Cr-enriched layer is formed on the steel composition layer, wherein the Cr-enriched layer also being formed from X, Y and Z, wherein the ratio of Y to X in the Cr-enriched layer being greater than the ratio of Y to X in the steel composition layer. The Cr-enriched layer has a surface roughness of less than 40 micro inches (1.1 μm). Preferably, the surface roughness is less than 20 micro inches (0.5 μm). Even more preferable is a surface roughness of less than 10 micro inches (0.25 μm). The corrosion resistant layer further includes an protective layer formed on the Cr-enriched layer.

BRIEF DESCRIPTION OF THE DRAWINGS

The invention will now be described in connection with the following drawings in which like reference numerals designate like elements and wherein.

DETAILED DESCRIPTION OF PREFERRED EMBODIMENTS

Figure 1:
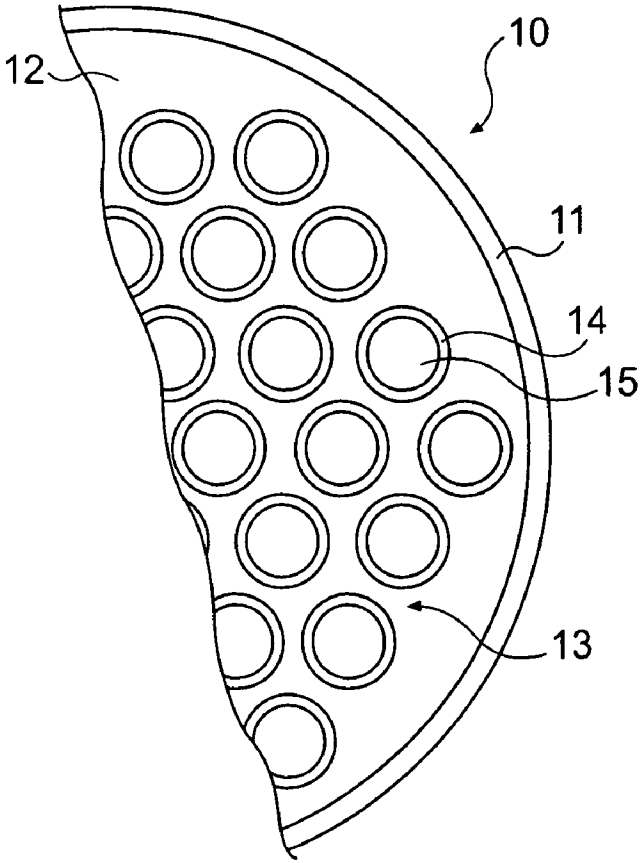
FIG. 1 is an example of heat exchanger having a plurality of heat exchanger tubes for use in a refinery operation.

The present invention will now be described in greater detail in connection with the attached figures. FIG. 1 is a tube-in-shell heat exchanger 10, which is located upstream from a furnace (not shown) and employs the principles of the present invention. The tube-in-shell heat exchanger 10 disclosed herein illustrates one application of the present invention to reduce sulfidation or sulfidic corrosion and depositional fouling in refinery and petrochemical applications. The tube-in-shell exchanger 10 is just one heat transfer component falling under the scope of the corrosion reduction and fouling mitigation measures in accordance with the present invention. The principles of the present invention are intended to used in other heat exchangers including but not limited to spiral heat exchangers, tube-in-tube heat exchangers and plate-and-frame heat exchangers having at least one heat transfer element. The principles of the present invention are intended to be employed in other heat transfer components including furnaces, furnace tubes and other heat transfer components which may be prone to petroleum and/or vacuum residual fouling. The heat exchanger 10 is used to pre-heat crude oil in a refinery operation prior to entry into the furnace. The heat exchanger 10 includes a housing or shell 11, which surrounds and forms a hollow interior 12. A bundle 13 of heat exchanger tubes 14 is located within the hollow interior 12, as shown in FIG. 1. The bundle 13 includes a plurality of tubes 14. The tubes 14 may be arranged in a triangular configuration or a rectangle configuration. Other tube arrangements are contemplated and considered to be well within the scope of the present invention. Each tube 14 has a generally hollow interior 15 such that the crude oil to be heated flows there through. The heating or warming fluid (e.g., vacuum residual stream) flows through the hollow interior 12 to pre-heat the crude oil stream as the stream flows through the hollow interior 15 towards the furnace. Alternatively, it is contemplated that the crude oil may flow through the hollow interior 12 of the housing 11. The housing 11 and the tubes 14 are preferably formed from a steel composition. It is contemplated that the housing 11 and the tubes 14 may be formed from the same material. It is also contemplated that the housing 11 and the tubes 14 may be formed from different materials. Typically, the tubes and the housing are formed from a carbon or low chromium content steel.

Figure 5:
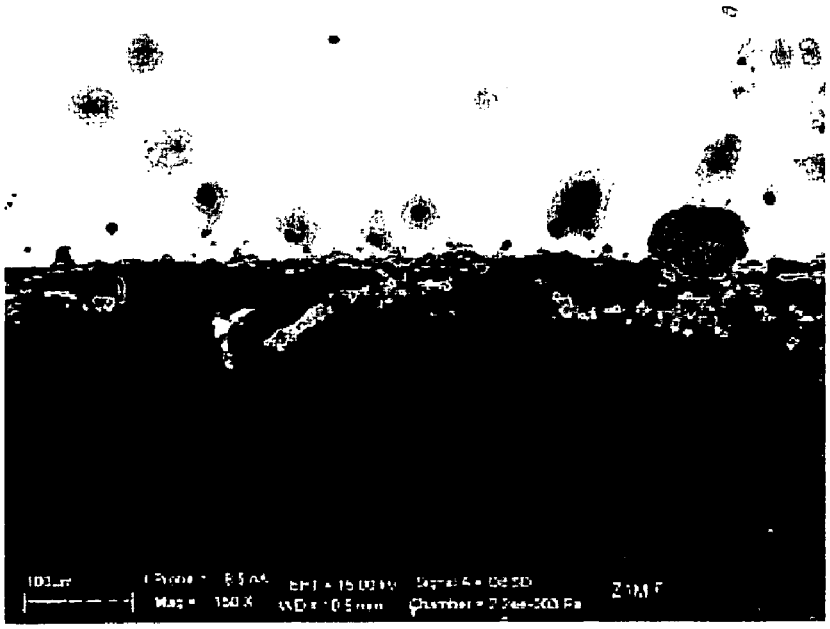
FIGS. 5 and 6 are images illustrating the fouling on a conventional heat exchanger tube after a field trial.
Figure 6:
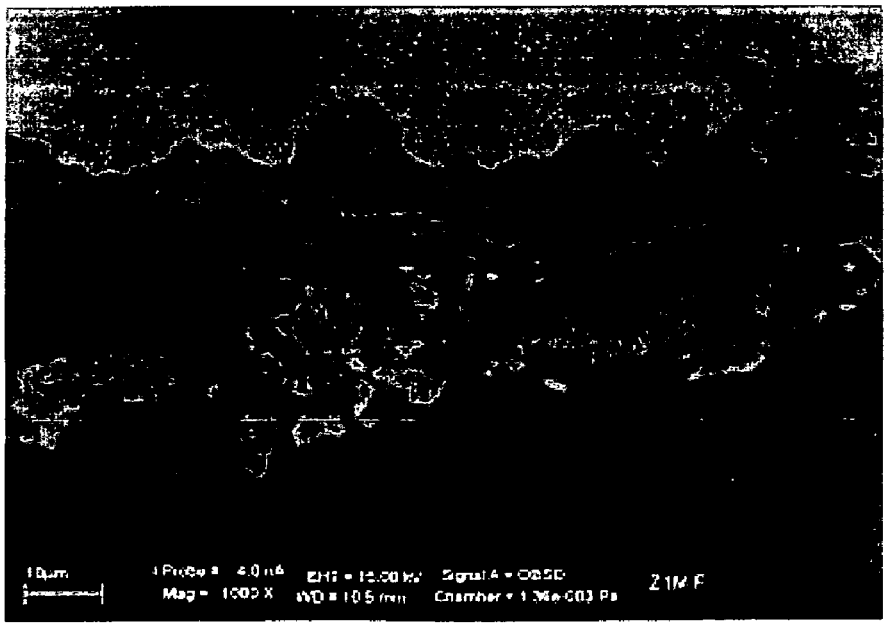

As described above, heat exchangers are typically subject to fouling after prolonged exposure to crude oil. The presence of fouling reduces the performance of the heat exchanger. FIGS. 5 and 6 illustrate the effects of fouling on the surface of a heat exchanger tube. The presence of fouling reduces throughput and increases fuel consumption. FIGS. 5 and 6 illustrate the amount of fouling present within the heat exchanger tube after five months of operation. This fouling represents an approximately 31% reduction in the heat exchanger efficiency in the refinery. The foulant contains sodium chloride, iron sulfide and carbonaceous materials. As shown in FIGS. 5 and 6, significant amounts of pitting are present. Pitting can further exacerbate the fouling problem.

Figure 7:
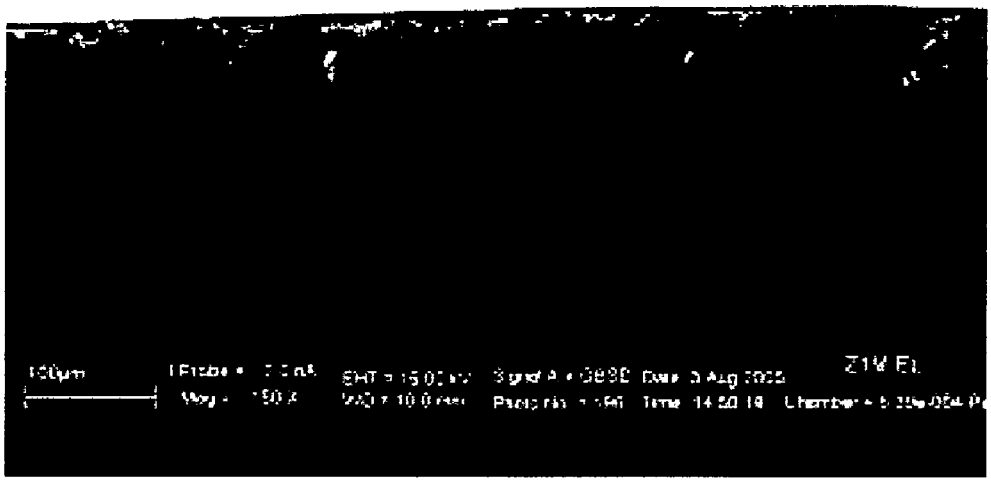
FIGS. 7 and 8 are images illustrating the significant reduction in fouling on a heat exchanger tube in accordance with the present invention after a field trial.
Figure 8:
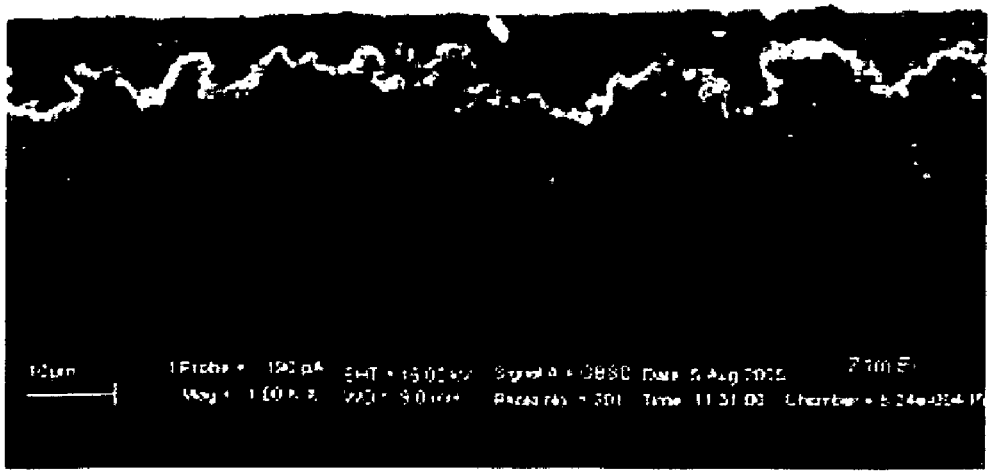

By contrast, FIGS. 7 and 8 illustrate the reduction in fouling utilizing heat exchanger tubes 14 which embody the principles of the present invention. The surface cross-sections illustrated in FIGS. 7 and 8 illustrate a marked reduction in fouling. These tubes were located in the same heat exchanger and subject to the same operating conditions over the same five month period. While the foulant present in the exchanger tube 14 also contained sodium chloride, iron sulfide and carbonaceous material, the amount of foulant was significantly reduced. The thickness of the foulant was reduced to less than 10 microns. The tubes having the reduced surface roughness also exhibited less pitting. The conventional tubes illustrated in FIGS. 5 and 6 exhibited a mean foulant deposit weight density of 46 mg/cm$^2$. By contrast, the tubes 14 constructed using principles in accordance with the present invention illustrated at least 50% reduction in the mean foulant deposit weight density. The sample tubes exhibited a mean foulant deposit weight density of 22 mg/cm$^2$. Deposit weight density was determined by the National Association of Corrosion Engineers (NACE) method TM0199-99. The reduction in fouling shown in FIGS. 7 and 8 illustrate the benefits of the present invention.

The reduction in fouling may be obtained as a result of controlling the surface roughness of the inner diameter surface and the outer diameter surface of the tubes 14 and/or the interior surface of the shell 11. Controlling the surface roughness of the inner diameter surface of the tubes mitigates the fouling of process fluid or crude oil within the tubes 14. Controlling the surface roughness of the outer diameter surface of the tubes 14 and the inner surface of the shell 11 mitigates fouling associated with the heating fluid (e.g., vacuum residual) flowing within the hollow interior 12. In accordance with the present invention, at least one of the interior surface of the hollow interior 12 and the surfaces of the tubes 14 has a surface roughness of less than 40 micro inches (1.1 μm). Surface roughness can be measured in many ways. Industry prefers to use a skidded contact profilometer. Roughness is routinely expressed as the arithmetic average roughness (Ra). The arithmetic average height of roughness component of irregularities from the mean line is measured within the sample length L. The standard cutt-off is 0.8 mm with a measuring length of 4.8 mm. This measurement conforms to ANSI/ASME B46.1 "Surface Texture-Surface Roughness, Waviness and Lay," which was employed in determining the surface roughness in accordance with the present invention. A uniform surface roughness of less than 40 micro inches (1.1 μm) produces a significant reduction in fouling.

Further reductions in surface roughness are desirable. It is preferable that the surface roughness be below 20 micro inches (0.5 μm). It is more preferable that the surface roughness be below 10 micro inches (0.25 μm). It is preferable that both the inner diameter surface and the outer diameter surface have the described surface roughness. The desired surface roughness may be obtained through various techniques including but not limited to mechanical polishing and electropolishing. In the samples illustrated in FIGS. 5 and 6, the surface roughness of the tubes was variable between 38 and 70 micro inches. The tubes in FIGS. 5 and 6 were not polished. The tubes illustrated in FIGS. 7 and 8, which form the basis for the present invention were polished to a more uniform 20 micro inches (0.5 μm). This was accomplished using conventional mechanical polishing techniques. The tubes were then electro-polished in an acidic electrolyte to produce a reflective surface having a surface roughness below 10 micro inches (0.25 μm). The treated tubes exhibited a marked reduction in fouling.

Figure 2:
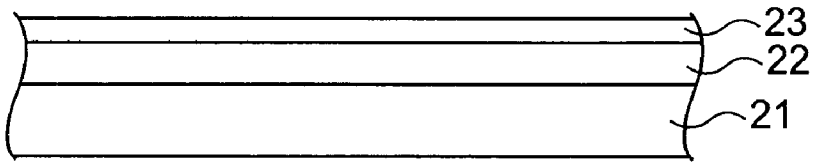
FIG. 2 is a schematic view illustrating the various layers forming the steel composition utilized in forming the heat transfer components in accordance with an embodiment of the present invention.
Figure 4:
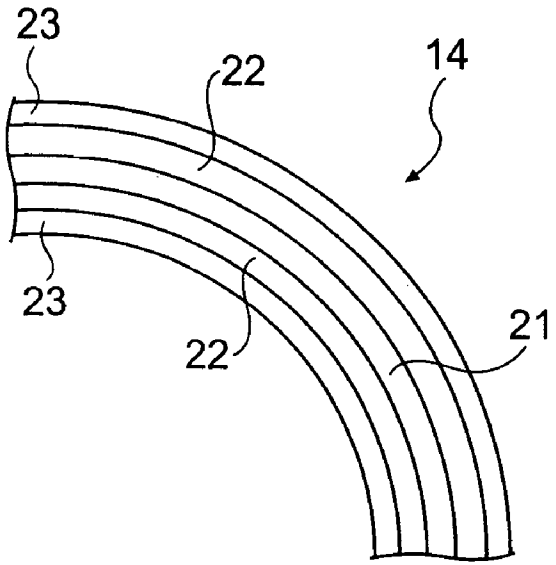
FIG. 4 is a partial sectional view of a heat exchanger tube in accordance with the present invention.

In accordance with the present invention, it is preferable that the tubes 14 be formed from a steel composition that is resistant to sulfidation or sulfidic corrosion and depositional fouling. The use of such a steel composition significantly reduces fouling, which produces numerous benefits including an increase in heating efficiency, a reduction in the amount of energy needed to pre-heat the crude oil, and a significant reduction in refinery downtime and throughput. It is preferable that the tubes 14 and/or the housing 11 of the preheat exchanger have several layers, as illustrated in FIGS. 2 and 4. The primary layer 21 is a steel composition containing three primary components or constituents X, Y and Z. X denotes a metal that is selected from the group preferably consisting of Fe, Ni, and Co. X may also contain mixtures of Fe, Ni and Co. Y denotes Cr. In accordance with the present invention, a steel composition contains Cr at least greater than 1 wt. % based on the combined weight of the three primary constituents X, Y and Z. Higher Cr contents are desirable for improved sulfidation or sulfidic corrosion resistance. It is preferable that the Cr content be higher than 5 wt. % based on the combined weight of three primary constituents X, Y and Z. It is more preferable that the Cr content be higher than 10 wt. % based on the combined weight of three primary constituents X, Y and Z. Z is preferably an alloying element.

In accordance with the present invention, Z preferably includes at least one alloying element selected from the group consisting of Si, Al, Mn, Ti, Zr, Hf, V, Nb, Ta, Mo, W, Sc, Y, La, Ce, Pt, Cu, Ag, Au, Ru, Rh, Ir, Ga, In, Ge, Sn, Pb, B, C, N, O, P, and S. Z may also contain mixtures of Si, Al, Mn, Ti, Zr, Hf, V, Nb, Ta, Mo, W, Sc, Y, La, Ce, Pt, Cu, Ag, Au, Ru, Rh, Ir, Ga, In, Ge, Sn, Pb, B, C, N, O, P, and S. The weight percent of an alloying element is preferably higher than 0.01 wt. %, and more preferably higher than 0.05 wt. %, and most preferably higher than 0.1 wt. %, based on the combined weight of three primary constituents X, Y and Z. The combined weight percent of all alloying elements in a steel composition is preferably less than 10 wt. %, and more preferably less than 5 wt. %, based on the combined weight of three primary constituents X, Y and Z. While other compositions are considered to be within the scope of the present invention, the above-described composition has been found to reduce fouling.

Table 1 illustrates non-limiting examples of a steel composition that is resistant to sulfidation or sulfidic corrosion and corrosion induced fouling for use in both refining and petrochemical applications. Other materials exhibiting similar properties are considered to be well within the scope of the present invention provided such materials fall within the scope of the prescribed ranges.

TABLE 1

| Name (Grade) | UNS Number | Constituent X in wt. % | Constituent Y in wt. % | Constituent Z in wt. % |
|---|---|---|---|---|
| T11 | K11562 | Balanced Fe | 1.25Cr | 0.5Mo, 0.5Si, 0.3Mn, 0.15C, 0.045P, 0.045S |
| T22 | K21590 | Balanced Fe | 2.25Cr | 1.0Mo, 0.5Si, 0.3Mn, 0.15C, 0.035P, 0.035S |

TABLE 1-continued

| Name (Grade) | UNS Number | Constituent X in wt. % | Constituent Y in wt. % | Constituent Z in wt. % |
|---|---|---|---|---|
| T5 | S50100 | Balanced Fe | 5Cr | 0.5Mo, 0.5Si, 0.3Mn, 0.15C, 0.04P, 0.03S |
| T9 | J82090 | Balanced Fe | 9Cr | 1.0Si, 0.35Mn, 0.02C, 0.04P, 0.045S |
| 409 | S40900 | Balanced Fe | 10.5Cr | 1.0Si, 1.0Mn, 0.5Ni, 0.5Ti, 0.08C, 0.045P, 0.045S |
| 410 | S41000 | Balanced Fe | 11.5Cr | 0.15C, 0.045P, 0.03S |
| 430 | S43000 | Balanced Fe | 16Cr | 1.0Si, 1.0Mn, 0.12C, 0.045P, 0.03S |
| XM-27 | S44627 | Balanced Fe | 25Cr | 0.5Ni, 0.75Mo, 0.4Si, 0.4Mn, 0.05Nb, 0.2Cu, 0.01C, 0.02P, 0.02S, 0.015N |
| SeaCure | S44660 | Balanced Fe | 25Cr | 1.5Ni, 2.5Mo, 1.0Si, 1.0Mn, 0.05Nb, 0.2Cu, 0.025C, 0.04P, 0.03S, 0.035N |
| 304 | S30400 | Bal. Fe, 8Ni | 18Cr | 2.0Mn, 0.75Si, 0.08C, 0.04P, 0.03S |
| 304L | S30403 | Bal. Fe, 8Ni | 18Cr | 2.0Mn, 0.75Si, 0.035C, 0.04P, 0.03S |
| 309S | S30908 | Bal. Fe, 12Ni | 22Cr | 2.0Mn, 0.75Si, 0.75Mo, 0.08C, 0.045P, 0.03S |
| 310 | S31000 | Bal. Fe, 19Ni | 24Cr | 2.0Mn, 1.5Si, 0.75Mo, 0.25C, 0.045P, 0.03S |
| 316 | S31600 | Bal. Fe, 11Ni | 16Cr | 2.0Mn, 0.75Si, 2.0Mo, 0.08C, 0.04P, 0.03S |
| 316L | S31603 | Bal. Fe, 11Ni | 16Cr | 2.0Mn, 0.75Si, 2.0Mo, 0.035C, 0.04P, 0.03S |
| 321 | S32100 | Bal. Fe, 9Ni | 17Cr | 2.0Mn, 0.75Si, 0.4Ti, 0.08C, 0.045P, 0.03S |
| 2205 | S32205 | Bal. Fe: 4.5Ni | 22Cr | 2.0Mn, 1.0Si, 3.0Mo, 0.03C, 0.14N, 0.03P, 0.02S |
| 2507 | S32507 | Bal. Fe: 6Ni | 24Cr | 1.2Mn, 0.8Si, 3.0Mo, 0.5Cu, 0.03C, 0.2N, 0.035P, 0.02S |
| AL-6XN | N08367 | Bal. Fe: 24Ni | 20Cr | 6.2Mo, 0.4Si, 0.4Mn, 0.22N, 0.2Cu, 0.02C, 0.02P, 0.03S, 0.035N |
| Alloy 800 | N08800 | Bal. Fe: 30Ni | 19Cr | 0.15Ti, 0.15Al |

The chromium enrichment at the surface of the non-fouling surface is advantageous. Therefore, the steel composition preferably includes a chromium enriched layer 22. The Cr-enriched layer 22 is formed on the primary layer 21. The layer 22 may be formed on both the inner surface and the exterior surface of the tubes. The thickness of the Cr-enriched layer 22 is greater than 10 angstroms. The Cr-enriched layer 22 contains the same three primary components or constituents X, Y and Z. X denotes a metal that is selected from the group preferably consisting of Fe, Ni, and Co. X may also contain mixtures of Fe, Ni, Co and Ti. Y denotes Cr. It is contemplated that Y may also comprise Ni, O, Al, Si and mixtures thereof. The percentage of Cr is higher in layer 22 when compared to the primary layer 21. In accordance with the present invention, Cr content in layer 22 is at least greater than 2 wt. % based on the combined weight of three primary constituents X, Y and Z. It is preferable that the Cr content be higher than 10 wt. % based on the combined weight of three primary constituents X, Y and Z. It is more preferable that the Cr content be higher than 30 wt. % based on the combined weight of three primary constituents X, Y and Z. In the layer 22, the ratio of Y to X is greater than the ratio of Y to X in the layer 21. The ratio should be greater by a factor of at least 2. The ratio should preferably be greater by a factor of at least four. More preferably, the ratio should be a greater by a factor of eight. Z is preferably an alloying element.

For example, 5-chrome steel (T5) nominally contains about 5 wt. % chromium per about 95 wt. % iron to give an untreated surface ratio of 0.05 in the primary layer 21. In the Cr-enriched layer 22, the ratio increased to at least 0.1, preferably to 0.2 and most preferably to 0.4 chromium atoms per iron atom in the surface layer of the heat exchanger tube. For 316L stainless steel, which has nominally 16 wt. % Cr, 11 wt. % Ni, 2 wt. % Mn, 2 wt. % Mo, the bulk ratio of chromium to iron would be 16/69=0.23. After treatment to enrich the surface chromium, the ratio may rise to at least 0.46, preferably 0.92 and most preferably 1.84.

In the Cr-enriched layer 22, Z preferably includes at least one alloying element selected from the group consisting of Si, Al, Mn, Ti, Zr, Hf, V, Nb, Ta, Mo, W, Sc, Y, La, Ce, Pt, Cu, Ag, Au, Ru, Rh, Ir, Ga, In, Ge, Sn, Pb, B, C, N, O, P, and S. The weight percent of an alloying element is preferably higher than 0.01 wt. %, and more preferably higher than 0.05 wt. %, and most preferably higher than 0.1 wt. %, based on the combined weight of three primary constituents X, Y and Z.

It is contemplated that the Cr-enriched layer 22 may be formed on two sides of the primary layer 21 such that both the interior surface and the exterior surface contain a Cr-enriched layer. The Cr-enriched layer 22 may be formed on the primary layer 21 using one of several techniques. The Cr-enriched layer may be formed by electro-polishing the tube in a solution containing chromic acid. This is effective when the Cr content in the steel composition is less than about 15 wt. %. It is also contemplated that the Cr-enriched layer 22 may be formed using various other formation techniques including but not limited to electroplating chromium onto another alloy such as a carbon steel, bright annealing, passivation, thermal spray coating, laser deposition, sputtering, physical vapor deposition, chemical vapor deposition, plasma powder welding overlay, cladding, and diffusion bonding. It is also possible to choose a high chromium alloy including but not limited to 304L stainless steel, 316 stainless steel and AL6XN alloy. In accordance with the present invention, the secondary layer 22 may be mechanically polished and/or electro-polished as described above in order to obtain a uniform surface roughness of less than 40 micro inches (1.1 μm), preferably less than 20 micro inches (0.5 μm) and more preferably less than 10 micro inches (0.25 μm). The desired surface roughness can also be achieved using fine abrasive polishing or metal peening.

The Cr-enriched layer 22 may be formed on the primary layer 21 by bright annealing the tube. Bright annealing is an annealing process that is carried out in a controlled atmosphere furnace or vacuum in order that oxidation is reduced to a minimum and the surface remains relatively bright. The process conditions such as atmosphere, temperature, time and heating/cooling rate utilized during the bright annealing process will be dependent on the metallurgy of the alloy being acted upon. The skilled artisan can easily determine the conditions based on the alloy's metallurgy. As a non-limiting example, the austenitic stainless steel such as 304L can be bright annealed in either pure hydrogen or dissociated ammonia, provided that the dew point of the atmosphere is less than −50° C. and the tubes, upon entering the furnace, are dry and scrupulously clean. Bright annealing temperatures usually are above 1040° C. Time at temperature is often kept short to hold surface scaling to a minimum or to control grain growth.

In accordance with the present invention, an protective layer 23 is preferably formed on the Cr-enriched layer 22. The Cr-enriched layer 22 is necessary for the formation of the protective layer 23. The protective layer may be an oxide layer, a sulfide layer, an oxysulfide layer or any combination thereof. The protective layer 23 preferably includes a material such as a magnetite, an iron-chromium spinel, a chromium oxide, oxides of the same and mixtures thereof. The layer 23 may also contain a mixed oxide sulfide thiospinel. While it is possible to form the protective layer 23 on the Cr-enriched layer 22 prior to installation of the tubes 14 within the housing 11 of the pre-heat exchanger 10, the protective layer 23 is preferably formed on the Cr-enriched layer 22 after the tubes 14 are located within the exchanger 10 and the pre-heat exchanger is operational. The protective layer 23 forms when the Cr-enriched layer is exposed to the process stream at high temperatures. In a late-train heat exchanger application, the protective layer forms at temperatures up to 400° C. In applications in a furnace or outside the late-train heat exchanger, the protective layer forms at temperatures up to 600° C. In petrochemical applications including use in steam cracker and reformer tubes, the protective layer forms at temperatures up to 1100° C. The thickness of the protective layer 23 is preferably greater than 100 nm, more preferably greater than 500 nm, and most preferably greater than 1 micron. As illustrated in FIGS. 6 and 7, a field trial of 5-chrome steel revealed about 1 micron thick Cr-enriched magnetite layer formed during about 4 months of period. Since the stream oil flowing within a heat exchanger tube is a highly reducing and sulfidizing environment, the protective layer 23 can further convert to a mixed oxide-sulfide layer or a thiospinel-type sulfide layer after prolonged exposure. Applicants note that the formation of the protective layer 23 is a result of the electropolishing of the Cr-enriched layer 21.

The formation of the protective layer further reduces fouling. The foulants, which form on the protective layer 23 exhibit significantly less adhesion characteristics when compared to foulants, which form on surfaces that do not have the protective layer. One benefit of this reduced adhesion lies in the cleaning of the heat exchange surface. Less time is required to remove any foulants from the tubes. This results in a decrease in downtime such that the pre-heat exchanger can be serviced in a more efficient manner and placed back online sooner. Also, with a less adherent deposit, on-line cleaning methods may become more effective or at least more rapid, which will further reduce downtime and throughput loss.

There are numerous additional benefits of reducing the surface roughness of the tubes 14. One of the benefits is the shifting from a linear growth rate of the foulant, which results in the continuous thickening of the foulant deposit; to an asymptotic growth rate which reaches a finite thickness and then stops thickening.

The tubes 14 disclosed above may be used to form new heat exchangers. The tubes 14 can also be used in existing exchangers as replacement tubes. The use of the tubes 14 should produce significant benefits in the refinery operations. In addition to reducing fouling, there is a reduction in the number of scheduled downtimes the heat exchangers operate more efficiently because the harmful effects of fouling are reduced. In addition, as demonstrated in the field test, the use of the tubes 14 will also prolong tube life due to reduced pitting corrosion.

The tubes 14 in accordance with the present invention may be used to retrofit an existing heat exchanger during a scheduled downtime. The existing tubes can be removed from the heat exchanger. The tubes 14 having the above described surface roughness and/or material composition are installed in the interior 12 of the housing 11. While it is preferable to replace all of the existing heat exchanger tubes with replacement tubes having the above-described construction in order to maximize the reduction in fouling, the present invention is not intended to be so limited. It is contemplated that only a portion of the existing heat exchanger tubes be replaced with replacement tubes. While such a construction may not result in the same reduction in fouling, a degree of fouling mitigation will be obtained. The determination of the number and location of existing tubes to be replaced by the replacement tubes can be determined by a physical inspection of the tubes within the bundle within the heat exchanger. The tubes located closest to the furnace may be more prone to fouling. As such, it is also contemplated that tubes located most closely to the furnace may be replaced with tubes 14.

It is another aspect of the present invention to reduce sulfidation corrosion and depositional fouling. While the primary objective of the present invention is to provide such resistance to corrosion and fouling in the context of heat exchangers subject to a flow of crude oil, the present invention is not intended to be so limited. It is contemplated that the present invention is suitable for use in other refining applications where the mitigation of fouling is a concern. In accordance with this aspect of the present invention, a method of providing sulfidation corrosion resistance and corrosion induced fouling resistance is disclosed. The method is suitable for use on a metal surface that is subject to a stream of crude oil and petroleum streams at temperatures up to 400° C. The method includes providing a metal layer 21 formed from a steel composition comprising X, Y, and Z. As discussed above, the material X is preferably a metal selected from the group consisting of Fe, Ni, Co, Ti and mixtures thereof. The material Y is Cr. It is contemplated that Y may also comprise Ni, O, Al, Si and mixtures thereof. The material Z is preferably at least one alloying element selected from the group consisting of Si, Al, Mn, Ti, Zr, Hf, V, Nb, Ta, Mo, W, Sc, Y, La, Ce, Pt, Cu, Ag, Au, Ru, Rh, Ir, Ga, In, Ge, Sn, Pb, B, C, N, O, P, and S. The metal layer 21 preferably includes a Cr-enriched layer 22 located thereon. The Cr-enriched layer 22 may be formed from the same material X, Y and Z, however, the ratio of Y to X in the Cr-enriched layer is greater than the ratio of Y to X in the metal layer. A protective layer 23 is formed on the surface of the Cr-enriched layer 22. The protective layer 23 is preferably formed by exposing the Cr-enriched layer to a crude oil or petroleum stream at high temperatures up to 400° C.

Figure 3:
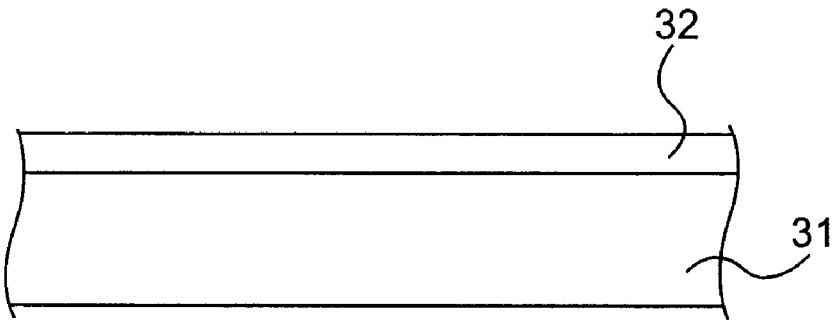
FIG. 3 is a schematic view illustrating the various layers forming the aluminum clad carbon steel utilized in forming the heat transfer components in accordance with an another embodiment of the present invention.

A variation of the present invention will now be described in greater detail in connection with FIG. 3. FIG. 3 illustrates an aluminum or aluminum alloy coated carbon steel that may be effective in reducing corrosion and mitigating fouling. A carbon steel layer 31 is coated or clad with an aluminum layer 32. The aluminum layer or aluminum alloy may be applied by immersion of the steel in molten aluminum or aluminum alloy or by thermal spraying of aluminum powder or wire that is atomized. When used in a tube 14, the aluminum layer 32 is located on both the inner diameter surface and the outer diameter surface of the tube 14 similar to the Cr-enriched layer 22.

It will be apparent to those skilled in the art that various modifications and/or variations may be made without departing from the scope of the present invention. While the present invention has been described in the context of the heat exchanger in a refinery operation. The present invention is not intended to be so limited; rather, it is contemplated that the desired surface roughnesses and materials disclosed herein may be used in other portions of a refinery operation where fouling may be of a concern. Reducing the surface smoothness of other corrosion resistant materials such as aluminized carbon steel, titanium, electroless nickel-coated carbon steel and other corrosion resistant surfaces are extensions of this concept as delineated below. It is contemplated that the method of reducing fouling disclosed herein can be combined with other reduction strategies to reduce fouling. This includes combining the low surface roughness and/or material compositions disclosed herein with vibrational, pulsation, helical shell-side baffles and internal turbulence promoters. Thus, it is intended that the present invention covers the modifications and variations of the method herein, provided they come within the scope of the appended claims and their equivalents.

What is claimed is:

1. A heat transfer component for heating a process stream, comprising:

a housing having a wall forming a hollow interior, wherein the wall having an inner surface;

at least one heat transfer element located within the housing for heating the process stream within the hollow interior of the housing;

wherein at least one of the inner surface and the at least one heat transfer element having a surface roughness of less than 40 micro inches (1.1 μm), wherein of the at least one heat transfer element being formed from a steel composition that is resistant to sulfidation corrosion and corrosion induced fouling, wherein the steel composition comprising:

X, Y, and Z, wherein X is a metal selected from the group consisting of Fe, Ni, Co and mixtures thereof, wherein is Y is Cr, and wherein Z is at least one alloying element selected from the group consisting of Si, Al, Mn, Ti, Zr, Hf, V, Nb, Ta, Mo, W, Sc, Y, La, Ce, Pt, Cu, Ag, Au, Ru, Rh, Ir, Ga, In, Ge, Sn, Pb, B, C, N, O, P, and S, each of the at least one heat transfer element having Cr-enriched layer formed thereon, wherein the Cr-enriched layer also being formed from the steel composition X, Y and Z, wherein the ratio of Y to X in the Cr-enriched layer being greater than the ratio of Y to X in the remaining portion of the heat transfer element, wherein the surface roughness of the Cr-enriched layer is less than 40 micro inches (1.1 μm), and a protective layer formed on an outer surface of the Cr-enriched layer, wherein the protective layer comprises an oxide selected from the group consisting of a magnetite, an iron-chromium spinel, a chromium oxide, and mixtures thereof.

2. The heat transfer component according to claim 1, wherein the surface roughness is less than 20 micro inches (0.5 μm).

3. The heat transfer component according to claim 2, wherein the surface roughness is less than 10 micro inches (0.25 μm).

4. The heat transfer component according to claim 1, wherein the Cr-enriched layer is formed by one of electropolishing at least on surface of heat transfer element, electroplating, thermal spray coating, laser deposition, sputtering, physical vapor deposition, chemical vapor deposition, plasma powder welding overlay, cladding, and diffusion bonding.

5. The heat transfer component according to claim 4, wherein the surface roughness of the Cr-enriched layer is less than 20 micro inches (0.5 μm).

6. The heat transfer component according to claim 5, wherein the surface roughness of the Cr-enriched layer is less than 10 micro inches (0.25 μm).

7. The heat transfer component according to claim 1, wherein the protective layer being formed within the at least one heat transfer element when subjected to a process stream at high temperatures up to 400° C.

8. The heat transfer component according to claim 1, wherein the protective layer being formed within the at least one heat transfer element when subjected to a process stream at high temperatures up to 600° C.

9. The heat transfer component according to claim 1, wherein the protective layer being formed within the at least one heat transfer element when subjected to a process stream at high temperatures up to 1100° C.

10. The heat transfer component according to claim 1, wherein the heat transfer component is a heat exchanger and the at least one heat transfer element is a tube bundle having a plurality of heat transfer tubes, wherein each of the heat transfer tubes having an inner diameter surface and an outer diameter surface, wherein at least one of the inner diameter surface and the outer diameter surface having a surface roughness of less than 40 micro inches (1.1 μm).

11. The heat transfer component according to claim 10, wherein the surface roughness is less than 20 micro inches (0.5 μm).

12. The heat transfer component according to claim 11, wherein the surface roughness is less than 10 micro inches (0.25 μm).

13. The heat transfer component according to claim 10, wherein each heat transfer tube being formed from the steel composition that is resistant to sulfidation corrosion and corrosion induced fouling.

14. A heat transfer component for heating a process stream, comprising:

a housing having a wall forming a hollow interior, wherein the wall having an inner surface;

at least one heat transfer element located within the housing for heating the process stream within the hollow interior of the housing;

wherein at least one of the inner surface and the at least one heat transfer element having a surface roughness of less than 40 micro inches (1.1 μm), wherein of the at least one heat transfer element being formed from a steel composition that is resistant to sulfidation corrosion and corrosion induced fouling, wherein the steel composition comprising:

X, Y, and Z, wherein X is a metal selected from the group consisting of Fe, Ni, Co and mixtures thereof, wherein is Y is Cr, and wherein Z is at least one alloying element selected from the group consisting of Si, Al, Mn, Ti, Zr, Hf, V, Nb, Ta, Mo, W, Sc, Y, La, Ce, Pt, Cu, Ag, Au, Ru, Rh, Ir, Ga, In, Ge, Sn, Pb, B, C, N, O, P, and S; and at least one tube sheet located therein for securing the plurality of heat transfer tubes within the housing; and at least one baffle located within the housing, wherein at least one of the at least one tube sheet and the at least one baffle having a surface having a surface roughness of less than 40 micro inches (1.1 μm).

15. The heat exchanger according to claim 14, wherein the surface roughness is less than 20 micro inches (0.5 μm).

16. The heat exchanger according to claim 15, wherein the surface roughness is less than 10 micro inches (0.25 μm).

* * * * *